US006062221A

United States Patent [19]

Brostrom et al.

[11] Patent Number: 6,062,221

[45] **Date of Patent: *May 16, 2000**

[54] DROP-DOWN FACE MASK ASSEMBLY

[75] Inventors: Gerald M. Brostrom, Burnsville, Minn.; David C. Byram, River Falls, Wis.

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,757

[22] Filed: Oct. 3, 1997

[51] Int. Cl.[7] ..... A62B 18/08

[52] U.S. Cl. ..... 128/206.27; 128/206.28; 128/207.11

[58] Field of Search ..... 128/206.27, 206.28, 128/207.11

[56] References Cited

U.S. PATENT DOCUMENTS

| | | | |
|---|---|---|---|
| 2,353,643 | 7/1944 | Bulbulian | 128/207.11 |
| 2,671,445 | 3/1954 | Charbonnel | 128/207.11 |
| 2,827,900 | 3/1958 | Marietta | 128/207.11 |
| 2,928,387 | 3/1960 | Layne | 128/207.11 |
| 3,056,402 | 10/1962 | Dickinson | 128/207.11 |
| 3,079,917 | 3/1963 | Pate | 128/206.27 |
| 3,092,105 | 6/1963 | Gabb | 128/206.27 |
| 3,117,574 | 1/1964 | Reploglo | 218/206.27 |
| 3,234,940 | 2/1966 | Morton, Jr. | 128/207.11 |
| 3,347,229 | 10/1967 | Heitman | 128/207.11 |
| 3,792,702 | 2/1974 | Delest | 128/146.7 |
| 4,603,692 | 8/1986 | Montesi | 128/207.11 |
| 4,850,346 | 7/1989 | Michel et al. | 128/206.15 |
| 4,934,361 | 6/1990 | Michel et al. | 128/206.17 |
| 4,960,121 | 10/1990 | Nelson et al. | 128/207.11 |
| 5,062,421 | 11/1991 | Burns et al. | 128/205.27 |
| 5,181,507 | 1/1993 | Michel et al. | 128/206.27 |
| 5,237,986 | 8/1993 | Seppala et al. | 128/207.11 |
| 5,464,010 | 11/1995 | Byram | 128/207.11 |
| 5,555,569 | 9/1996 | Lane | 128/207.11 |

FOREIGN PATENT DOCUMENTS

| | | | |
|---|---|---|---|
| 0085746 | 8/1983 | European Pat. Off. . | |
| 0 808 641 A1 | 11/1997 | European Pat. Off. . | |
| 535040 | 10/1931 | Germany | 128/207.11 |
| 141110 | 4/1980 | Germany | 128/207.11 |
| 9300181 U | 3/1993 | Germany . | |
| 195 16 859 A1 | 11/1995 | Germany . | |
| 34-12900 | 8/1959 | Japan . | |
| WO 86/01734 | 3/1986 | WIPO . | |

OTHER PUBLICATIONS

Product Literature: "Gas Masks," Model GM–12D–1, GM, 1994.

*Primary Examiner*—Aaron J. Lewis
*Attorney, Agent, or Firm*—James A. Rogers

[57] ABSTRACT

An improved face mask that is retained by a carriage and harness assembly, thereby allowing the face mask to drop down from the face of the wearer.

7 Claims, 6 Drawing Sheets

DROP-DOWN FACE MASK ASSEMBLY

TECHNICAL FIELD

The present invention generally relates to face masks, and more particularly, to a face mask that is retained by a carriage and harness assembly thereby allowing the face mask to drop down from the face of the wearer.

BACKGROUND

Face masks for covering the nose and mouth of the wearer are used to protect the wearer from airborne contaminants. Such masks are well known and come in several varieties. Some masks are of single construction and include filtering material covering the mouth and nose of the wearer and are attached by elastic bands extending around the head of the wearer. Other masks utilize a solid mask body with inhalation and exhalation valves formed in the mask. Still other masks utilize interchangeable filter cartridges.

A face mask should be easy to don, doff, and adjust. A mask that is quickly fitted saves time and protects the wearer under changing environmental conditions.

A face mask should form a reliable seal between the mask and the face of the wearer despite various facial configurations. Also, the face mask should be adaptable to different environments and be interchangeable with other filters.

Many existing face mask securing means have shortcomings. Often, the need arises to temporarily remove the face mask. For example, the wearer often needs access to his or her mouth. Also, the environment may be temporarily free of contaminants so that the wearer doesn't immediately need air filter protection. When wearing protective head gear, such as a hard hat, the wearer must remove the hard hat when donning or doffing the face mask. Once the wearer removes the mask, the mask is typically set aside where it may be contaminated and is often thrown away. When the wearer needs to redon the mask, he or she must first locate the mask and then readjust the mask to his or her face. Often, the wearer will grab a new mask and ignore or discard the original mask, thereby wasting time and increasing the cost of maintaining an adequate face mask supply.

Accordingly, a need exists for a face mask that is easy to don, adjustable, allows the wearer to drop the mask down and yet provides a tight seal between the face and the mask.

SUMMARY

The present invention provides a face mask apparatus. The mask has a mask body configured for covering the nose and mouth of the wearer. A carriage is permanently or detachably connected to the mask body. The carriage has at least four spaced apart guides or engagement points. The carriage may be adapted for use with a variety of masks.

A harness assembly connects to the carriage at the at least four spaced apart engagement points. The harness assembly is configured to extend about the head of the wearer.

The harness may include a support crown. The support crown extends about the head of the wearer. In this configuration, a band(s) connects the support crown to the carriage.

One advantage of the present invention is that the mask body is capable of being retained at multiple positions without removing the harness. The mask body is able to be retained at a first position covering the nose and mouth of the wearer and at a second position dropped down from the face of the wearer without moving the harness assembly from the head of the wearer. The mask hangs near the user's body in the dropped down position. This is advantageous in situations where the user needs access to his or her mouth and does not have to take the time to set the mask down and re-don the mask when the mask is needed. Also, the mask is out of the user's way when hanging near the body, thereby allowing substantially unobstructed working conditions. This flexibility saves time and protects the mask and accompanying filters from contamination. In addition, the mask is easily adjusted and conforms to multiple facial configurations.

Another advantage is that the mask is held at four points against the face of the wearer. This four point seal provides greater protection against contaminants. Also, the carriage may be separable from the mask body, allowing different variations of mask bodies to be attached to the carriage. This interchangeability allows the user to select the appropriate mask body and filter for the environment in which the wearer is working.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DESCRIPTION OF THE DRAWINGS

Referring now to the drawings wherein like reference letters and numerals indicate corresponding structure throughout the several views.

DETAILED DESCRIPTION

Figure 1:
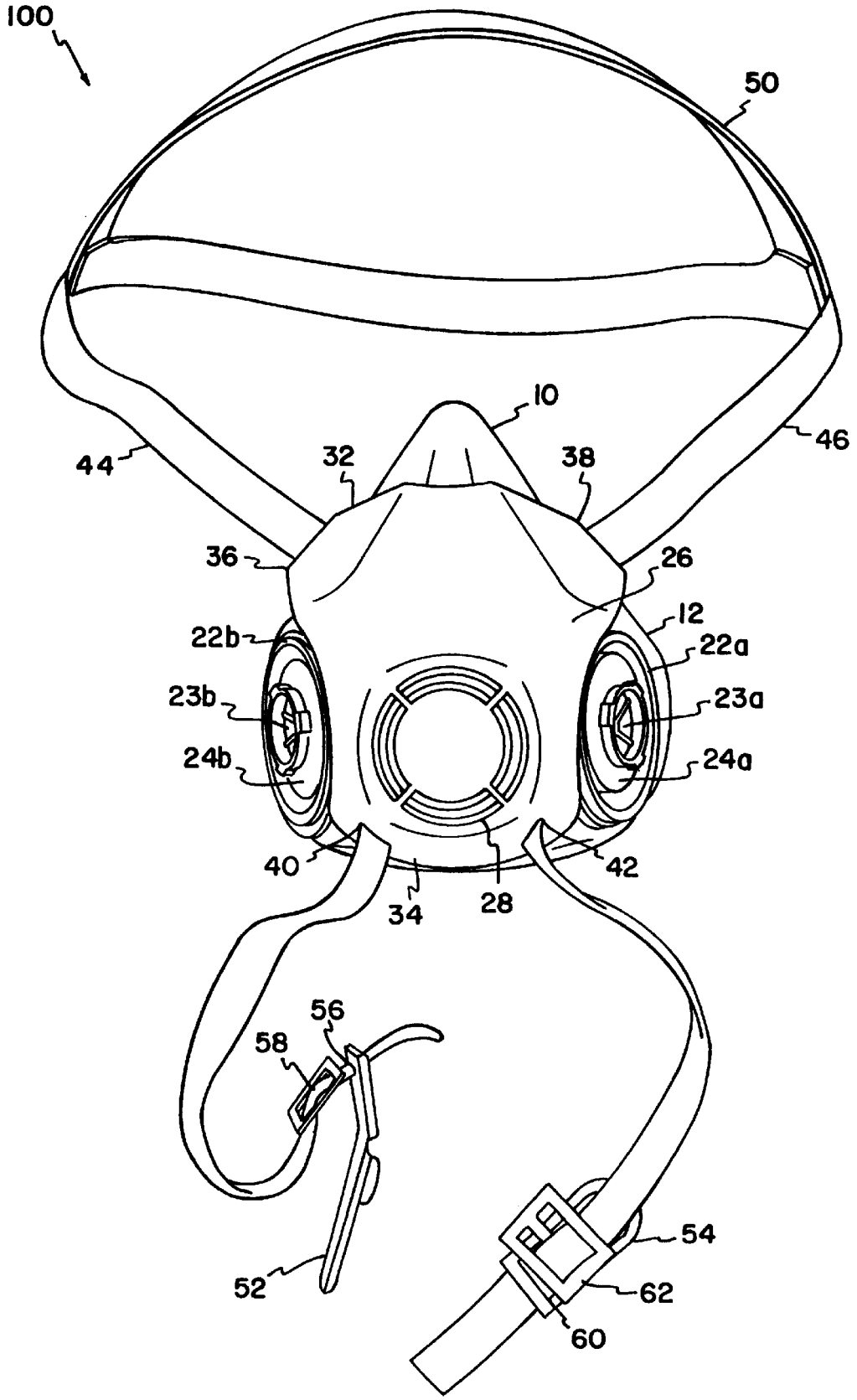
FIG. 1 shows a front perspective view of the face mask according to the principles of the present invention.

An embodiment of the invention will be described in detail with reference to the drawings, wherein like reference numerals represent like parts and assemblies throughout the several views. Reference to this embodiment does not limit the scope of the invention, which is limited only by the scope of the claims attached hereto.

In general, the present invention relates to a face mask. More particularly, the present invention relates to a face mask apparatus that is retained by a carriage and harness assembly on the head of the wearer allowing the face mask to drop down from the face of the wearer.

Figure 2:
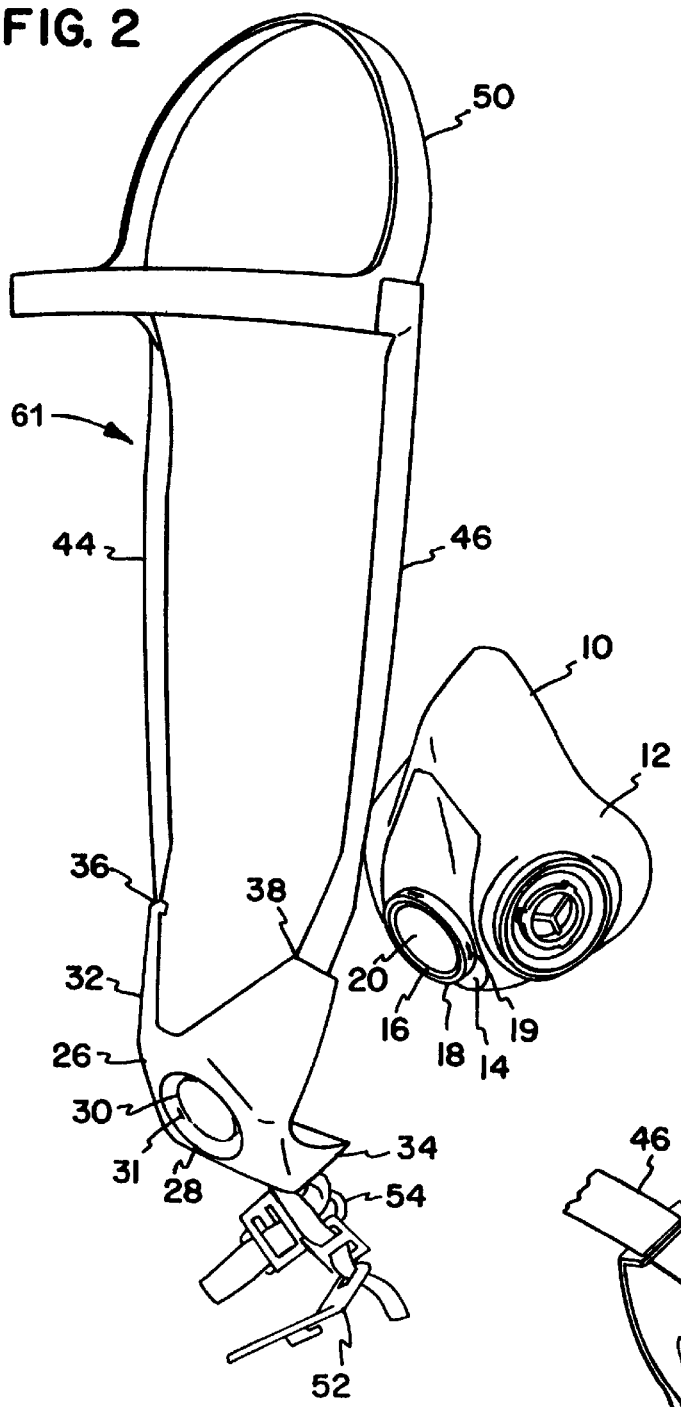
FIG. 2 shows a perspective view of a carriage of the present invention detached from the mask.

Referring now to FIGS. 1 and 2, a face mask generally shown as 100, is configured to fit over the mouth and nose of a wearer. The face mask 100 has a mask body 10. Many such masks are known such as the Series 6000™ by Minnesota Mining and Manufacturing Company, the 5500 by North Safety Products, and the Advantage 200 by MSA. By way of description, the typical mask body has a seal portion 12 and a central portion 14. The seal portion 12 is configured to provide a seal against the face of the wearer. The seal portion 12 may be constructed of rubber-like material and is generally contoured to serve as a sealing surface. The central portion 14 is generally constructed of rigid material and serves as a support for the seal portion 12.

An exhalation port 16 is typically located on the central portion 14. A lip member 18 may be located on the outer circumferential wall of the exhalation port 16. The lip member 18 is recessed away from the mask body 10. The lip member 18 may have four grooves 19 located on the outer wall. A valve 20 is positioned across the outside of exhalation port 16 such that the valve 20 covers the entire port 16, thereby forming a substantially airtight seal. The valve 20 acts as a one-way valve, allowing air to exit out of the mask, but preventing air from entering the mask when the wearer breathes in. Such valves are well understood in the art.

Inhalation ports 22*a* and 22*b* are typically disposed on opposite sides of the exhalation port 16. Inhalation valves 23*a* and 23*b* are located across ports 22*a* and 22*b*, respectively, thereby forming a substantially airtight seal. The inhalation valves 23*a* and 23*b* act as a one-way valve allowing air to enter the mask body when the wearer breathes in, but preventing air from escaping the mask body when the wearer exhales. Inhalation seals 24*a* and 24*b* are located within inhalation ports 22*a* and 22*b* and proximal to inhalation valves 23*a* and 23*b*, respectively. Inhalation seals 24*a* and 24*b* seal off the inhalation ports 22*a* and 22*b* such that substantially all inhaled air passes through inhalation valves 23*a* and 23*b*, respectively. Filters (not shown) may be placed over the inhalation ports 22*a* and 22*b* to remove particulates, vapors, aerosols, or other toxins from incoming air as is well known in the art. The particular filter may take a variety of different forms depending upon the impurities to be filtered. For example, a filter cartridge, as is well known in the art, is attached to each inhalation port, thereby providing filtering capabilities.

A carriage 26 is associated with the mask body 10. The carriage may be permanently or detachably connected to the mask body. In a preferred embodiment, the carriage 26 is configured to substantially match the contours of the mask body 10, such that the carriage fits over the mask body 10. The carriage 26 is removably connected to the mask body 10 by conventional connecting means. The carriage 26 is constructed of substantially rigid material such as plastic. A port 28 is located on the carriage 26 such that the air exiting the exhalation port 16 is channeled through the port 28.

In one configuration, the port 28 is located to align with the exhalation port 16 of the mask body 10. A lip member 30 is located on the outer circumferential wall of the port 28. The lip member 30 has four protrusions 31 located on the inner circumferential wall of the lip member 30. The protrusions 31 are configured to connect with the grooves 19 of the lip member 18, thereby connecting the mask body 10 and the carriage 26. The size of the lip 18, grooves 19, lip 30, and protrusions 31 are designed such that the mask body 10 snaps into the carriage 26 to form an attachment. The attachment is such that a force encountered under ordinary working conditions will not disengage the carriage 26 from the mask body 10. The mask body 10 and the carriage 26 are detached by manually forcing the carriage 26 away from the mask body 10. Other conventional attachment means can be used and the present invention is not limited to the lip-to-lip attachment system disclosed. For example, that attachment may involve a number of protrusions snapping into a complimentary number of recesses. Furthermore, the attachment system is not limited to being located on the exhalation or inhalation ports. The attachment systems allows for the attachment of different mask bodies with different seal and filter characteristics to the carriage 26.

The carriage 26 may be permanently or detachably connected to the mask body 10. The carriage may have a strap retainer (described below). In a preferred embodiment, the carriage 26 is detachably connected to mask body 10. The carriage 26 has an upper portion 32 and a lower portion 34. The upper portion 32 matches the shape of the mask body 10 and angles back near the seal portion 12. The lower portion 34 matches the general shape of the mask body 10 and angles back near the seal portion 12. The upper portion 32 has a first upper guide 36 and a second upper guide 38. The lower portion 34 has a first lower guide 40 and a second lower guide 42. The guides are designed to accommodate a strap and may take the form of slots, eyelets, or any structure having a suitable opening that permits the strap to move within the opening.

Figure 6:
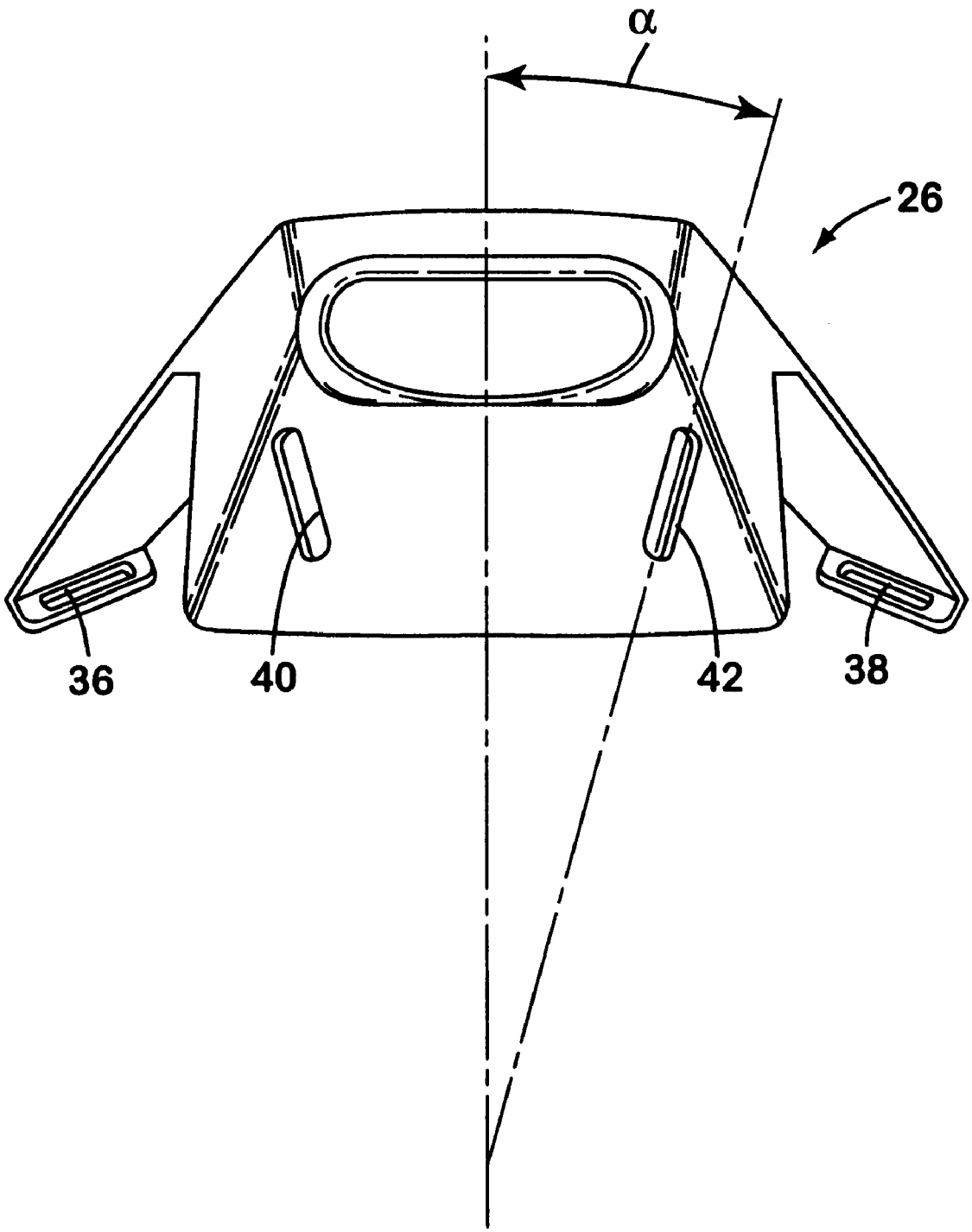
FIG. 6 shows a bottom perspective view of a carriage of the present invention.

The lower guides 40, 42 are angled to permit the mask body to be pulled in an up and down direction relative to the wearer's face and the strap(s) (discussed more fully below in connection with the harness) to be pulled about the wearer's head without substantially binding and consequently damaging the straps. The angles facilitate adjustment of the band about the head. In a preferred embodiment, the angle $\alpha$ as measured from a vertical plane in relation to the mask (as depicted in FIG. 6) is about 15° to about 45°, with a range of about 20° to about 30° being most preferred. The upper guides may be angled in a similar manner.

Figure 3:
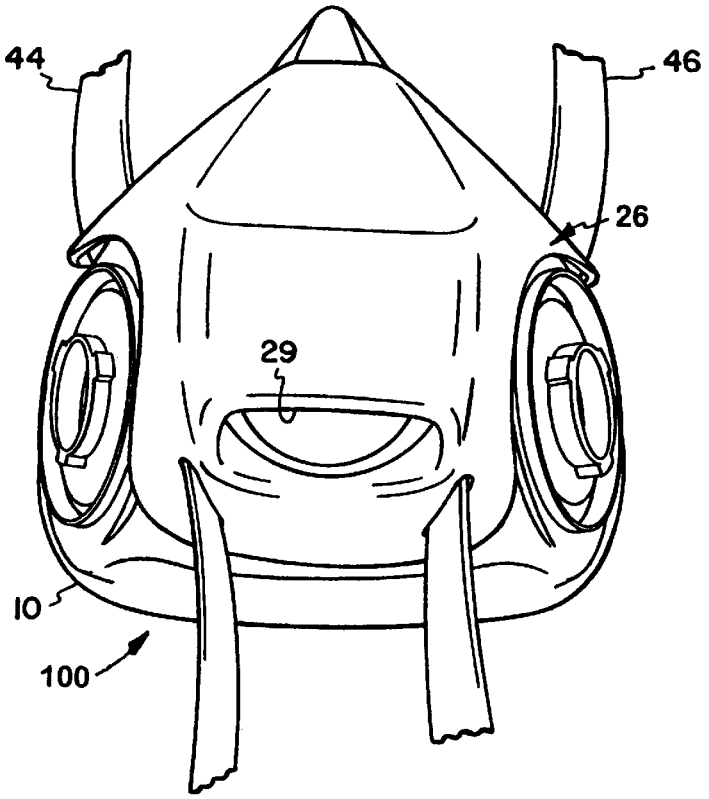
FIG. 3 shows a front perspective view of an alternative embodiment of the face mask of the present invention utilizing an alternative carriage configuration.

FIG. 3 shows an alternative embodiment of a face mask apparatus, similar to face mask apparatus 100, utilizing an alternative carriage configuration. A carriage 26 has a port 29 located on the lower portion of the carriage 26 and directed down from the carriage 26. The port 29 is located such that in operation, exhaled air will be directed down and away from the wearer's head. This configuration has several advantages. Users often wear face shields in combination with the face masks. Face shields may fog up upon direct impact by exhaled air, thereby reducing visibility. The port 29 directs air away from the face shield, preventing the face shield from fogging up. In addition, the downward location of the port 29 maintains the integrity of the exhalation valve 20 by reducing the amount of direct contact with airborne particulates. Often, heavy airborne particulates such as paint and dust are blown directly at the user's face and may degrade an exposed exhalation valve.

Figure 4:
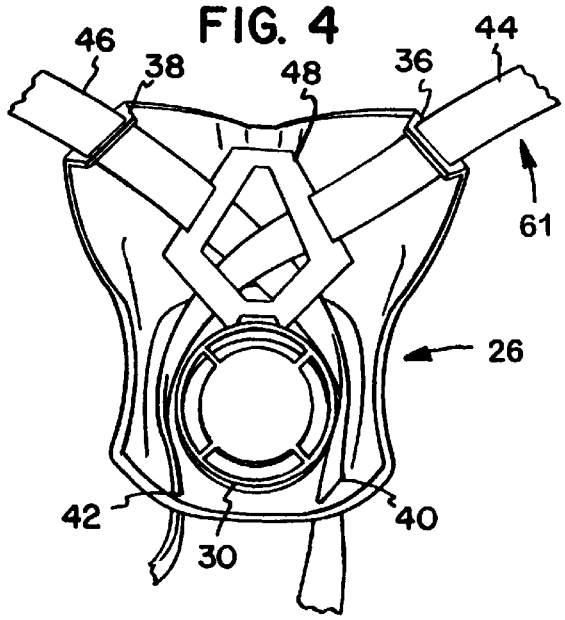
FIG. 4 shows a back perspective view of the carriage of the face mask shown in FIG. 1.

Harness 61 may comprise a single or multiple straps and may have a support crown. Referring now to FIG. 4, in a preferred embodiment, harness 61 has a first strap 44 and a second strap 46. First strap 44 passes from the first upper guide 36 to the second lower guide 42. Similarly, a second strap 46 passes from the second upper guide 38 to the first lower guide 40. The guides are located in a generally symmetrical position at the four general corners of the carriage 26. The location of the guides act as general pressure points. At these points, when the mask is donned, the carriage 26 pushes down on the seal 12, thereby compressing the seal 12 against the face of the wearer. This four point seal configuration is advantageous in a drop-down configuration over a two point seal system because the pressure is evenly distributed over the seal portion 12, thereby forming an evenly pressurized seal against the face of the wearer. This configuration serves as protection from outside contaminants and serves to conform to different facial configurations. As a result, the face mask of the present invention can be worn by a wide number of persons.

In a preferred embodiment, the first strap 44 and second strap 46 cross-over at the inside of the carriage 26. A strap retainer 48 is provided to guide the straps to this crossover position and to the respective guides. The strap retainer 48 has two sets of oppositely disposed guides to direct the straps to the crossover position. The strap retainer 48 is constructed of sufficiently rigid material. The strap retainer 48 ensures that the straps are smoothly guided to the proper position when the mask is adjusted along the straps. The crossing over of the straps 44 and 46 acts to provide even pressure on the seal 12, thereby improving the sealing characteristics.

Figure 5:
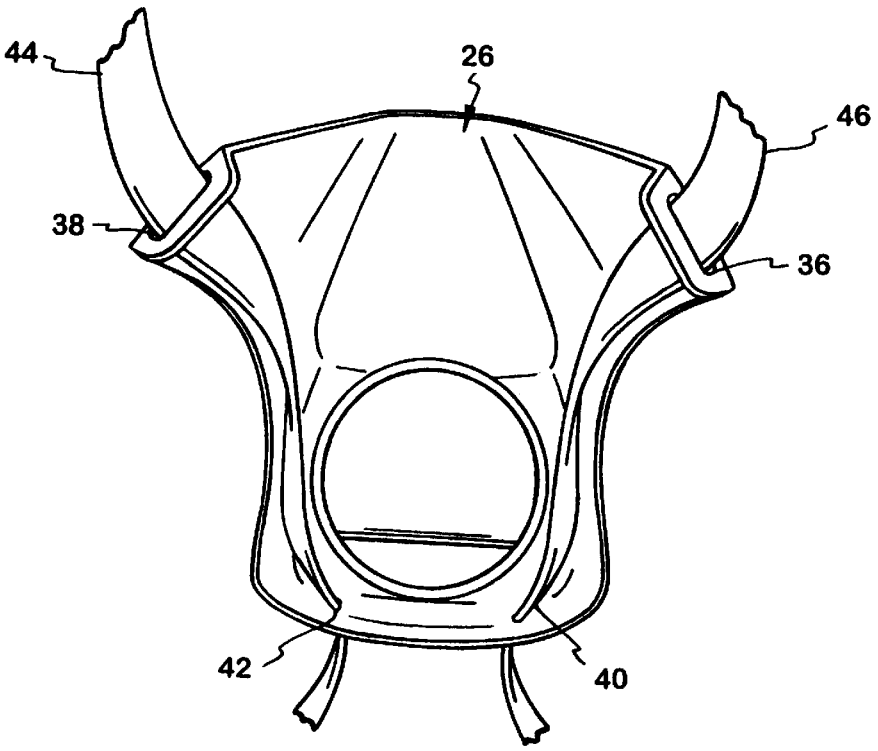
FIG. 5 shows a back perspective view of an alternative carriage configuration of the face mask according to principles of the present invention.

In an alternative embodiment as depicted in FIG. 5, the straps do not cross-over. The carriage 26 has a first upper guide 36, a second upper guide 38, a lower first guide 40, and a lower second guide 42. A first strap 44 passes from the first upper guide 38 to the first lower guide 42. A second strap 46 passes from the second upper guide 36 to the second lower guide 40.

Referring back to FIGS. 1–2, the first strap 44 and the second strap 46 have proximal and distal ends. The proximal ends of the first strap 44 and the second strap 46 may have attachment means as disclosed below in connection with the distal ends of the straps or may be connected to a support crown 50. The support crown 50 is generally oval shaped and configured to fit and conform to the head of the wearer. The support crown 50 is constructed of substantially flexible material to conform to the wearer's head. The support crown 50 is of conventional design. The support crown 50 is designed such that protective head gear can be fitted over the support crown 50 without causing undue discomfort. It is often necessary to wear protective head gear, such as a hard hat, in conjunction with a face mask. Alternative support crowns can be used without deviating from the spirit of the present invention.

The distal ends of the first strap 44 and second strap 46 are provided with strap connectors. The first strap 44 and second strap 46 are formed of elastic fabric material as is well known in the art. In an alternative embodiment, the straps are formed of rigid material and are flexibly connected to the support crown 50 so to provide resiliency.

In one embodiment, a connector assembly is attached to the distal ends of the straps. In a preferred embodiment, one strap has a hook 52 and the other has an eye fastener 54. The hook 52 and eye 54 are configured to connect to each other as is well known in the art. The hook 52 may have an adjustable buckle 58. The adjustable buckle 58 is configured such that the hook 52 can be adjusted along the strap 44 and the hook 52 will not freely slip on the first strap 44. The adjustable buckle 58 holds the strap 44 into place. Similarly, the eye 54 may have an adjustable buckle 62 to hold the strap 46 into place. The position of the hook 52 and eye 54 on the straps determines the fit of the mask, and can be adjusted to accommodate different facial configurations and desired tightness. Other conventional connectors and adjusters can be used such as hook and loop fastener materials.

In an alternative embodiment, the distal ends of the straps connect to the support crown 50 behind the head of the wearer. Each strap has an eyelet that connects to a corresponding hook located on the support crown 50. This has the advantage of increased comfort, as straps more freely turn with head and support crown movement. This is advantageous when the movement of the support crown 50 is severely restricted, such as when the user is wearing protective head gear. When the straps are connected to each other, strap movement is restricted and can cause discomfort on the back of the head of the wearer.

Figure 7:
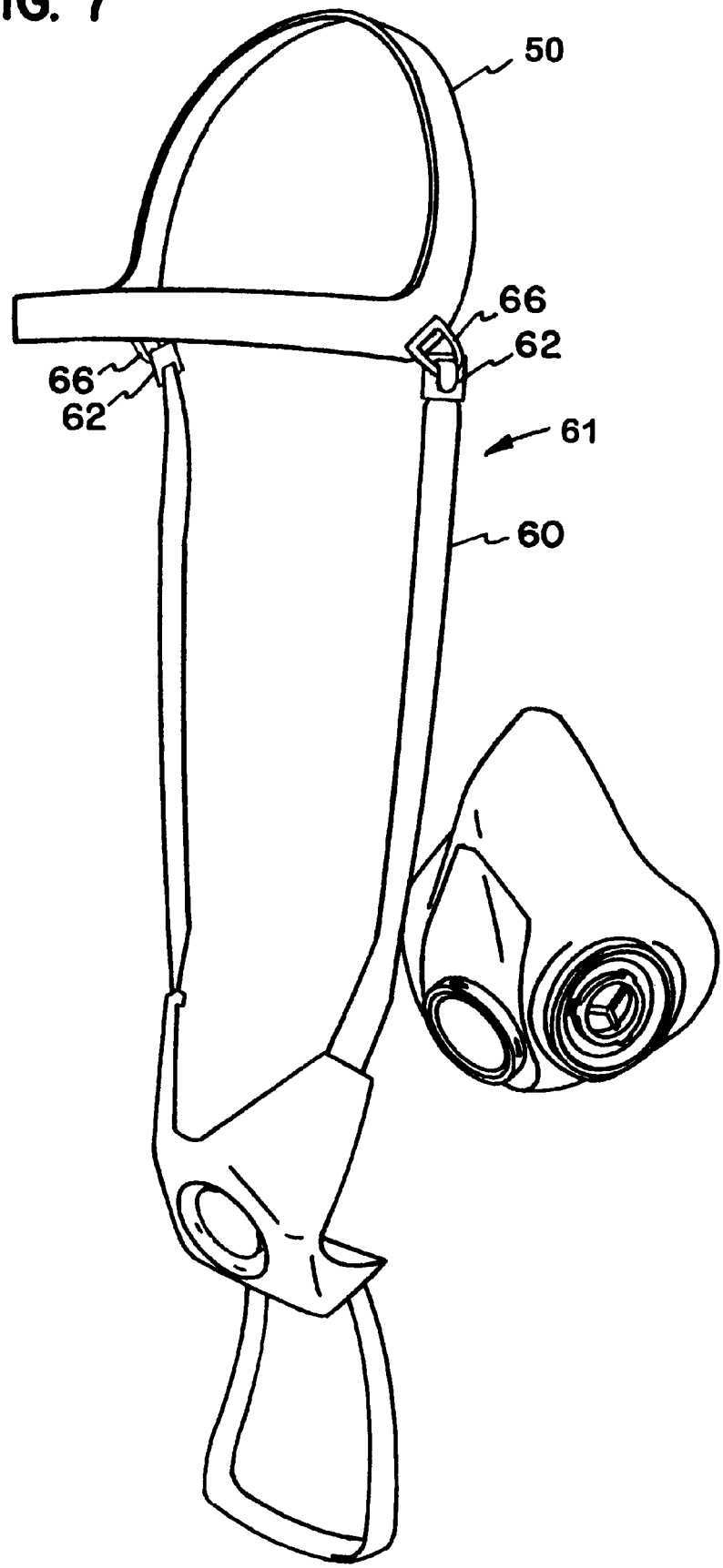
FIG. 7 shows a perspective view of an alternative carriage detached from the mask showing a continuous strap according to principles of the present invention.

FIG. 7 shows another alternative embodiment utilizing one continuous strap connecting to opposite sides of the harness. A continuous strap 60 has a hook 62 on each end. A harness 61 has a loop 66 on each side. The hooks 62 are designed to attach to the corresponding loops 66 located on the harness. The strap 60 is continuous and wraps around the neck of wearer. When doffing the face mask, the hooks 62 are disconnected from the loops 66 thereby releasing the strap 60 and allowing the mask to drop down to a position below the face of the wearer. The harness 61 remains resting on the head of the wearer, and the strap 60 remains hanging around the neck of the wearer.

In yet another alternative embodiment, the ends of a continuous strap connect to opposite sides of a protective head gear, such as a hard hat. A harness is no longer necessary because the straps connect directly to the hard hat. The hard hat has suitable means to connect to the strap. This is advantageous in an environment that requires the constant use of a hard hat.

Figure 8:
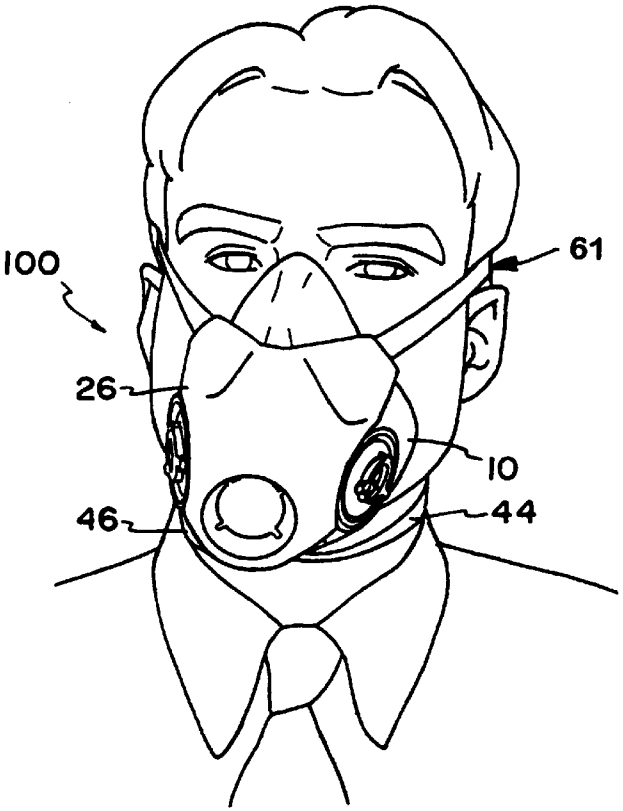
FIG. 8 shows a perspective view of the face mask of FIG. 1 fully donned according to the principles of the present invention.

Referring now to FIG. 8, in operation, the face mask 100 is donned by placing the harness 61 about the wearer's head. The face mask is slid up along the straps 44 and 46 to a position covering the nose and mouth of the wearer. The straps 44 and 46 are then connected about the head of the wearer. The straps 44 and 46 are adjusted so that a suitable fit is obtained. In one embodiment, the hook 52 and eye 54 connect the straps 44 and 46 around the head of the wearer. The hook 52 and eye 54 are adjusted along the respective strap until a suitable fit is obtained.

Figure 9:
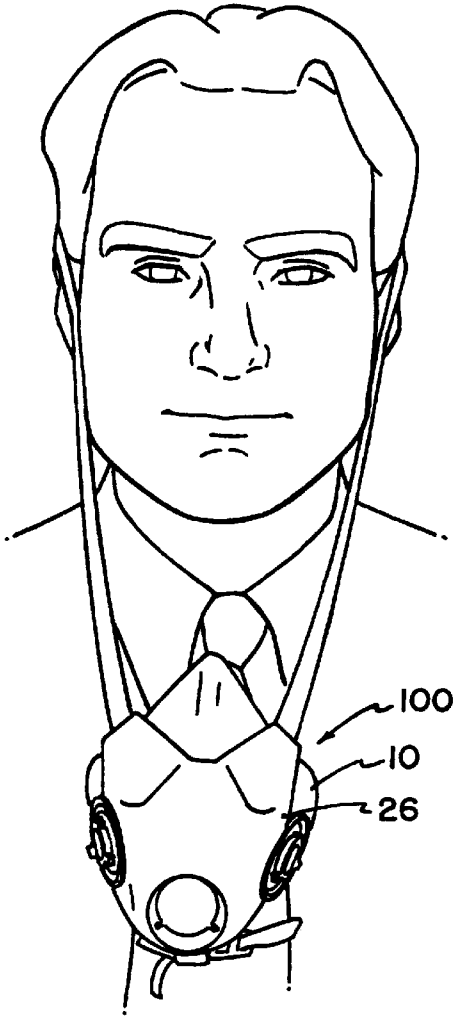
FIG. 9 shows a perspective view of the face mask of FIG. 1 in the dropped down position according to the principles of the present invention.

Referring now to FIG. 9, the face mask 100 is dropped down to a position below the face of the wearer. The face mask is dropped down by disconnecting straps 44 and 46 from behind the head of the wearer. The face mask is then slid down straps 44 and 46 to a suitable position. The face mask hangs near the wearer's body. The harness 61 remains on the wearer's head. With the mask in the dropped down position, the wearer can perform his tasks while having access to his or her mouth. Also, since the mask hangs near the wearer's body, the weare's view is relatively unobstructed. The mask does not slip freely along the straps. An increased force is needed to move the mask because the mask will not slide under its own weight.

When the mask is needed, the wearer simply slides the face mask up to his or her nose and mouth and connects straps 44 and 46 behind the head, and balances tension by pulling on the straps. This provides for quick donning which is highly advantageous. Often, environments become quickly contaminated, and the wearer must be able to quickly don the face mask. This is not possible where the wearer must retrieve the mask, or where the wearer must spend time readjusting the mask.

Although the description of the preferred embodiment and method have been quite specific, it is contemplated that various modifications could be made without deviating from the spirit of the present invention. Accordingly, it is intended that the scope of the present invention be dictated by the appended claims, rather than by the description of the preferred embodiment.

It is claimed:

1. A mask apparatus, comprising:

a face mask body configured for covering a wearer's nose and mouth;

a carriage having at least four spaced apart engagement points;

a harness assembly configured to extend about a wearer's head wherein the harness assembly includes first and second straps slidably crossing at the mask body; and a strap retainer for guiding the straps in a crossed configuration wherein said carriage and said harness are adapted for retaining the mask body at a first position covering a wearer's nose and mouth, and at a second position dropped down from a wearer's face without removing the harness assembly from a wearer's head.

2. The mask apparatus according to claim 1, wherein the carriage is removably attached to the mask body.

3. The mask apparatus according to claim 1, wherein the carriage has a central portion and an outer portion and the central portion defines an air passage.

4. A mask apparatus according to claim 1, wherein the carriage has a central portion and an outer portion, the outer portion defines an air passage such that air passing through the air passage is directed away from the carriage.

5. A mask apparatus according to claim 1, wherein the carriage has a central portion and an outer portion, and the outer portion defines an air passage such that air passing through the air passage is directed downward from the mouth of a wearer.

6. The mask apparatus according to claim 1, wherein the the first strap is adjustably connected to a hook fastener and the the second strap is adjustably connected to an eye fastener.

7. The mask apparatus of claim 1, wherein said strap retainer retains said straps in a crossed configuration intermediate the mask body and the carriage.

* * * * *